US005913793A

United States Patent [19]

Hills

[11] Patent Number: 5,913,793

[45] Date of Patent: Jun. 22, 1999

[54] METHOD AND APPARATUS FOR MANUFACTURING CONCRETE PANELS AND FOR CONSTRUCTING A WALL WITH THE PANELS

[76] Inventor: Craig A. Hills, 7754 E. Coronado Rd., Mesa, Ariz. 85207

[21] Appl. No.: 09/084,764

[22] Filed: May 26, 1998

[51] Int. Cl.[6] ..... E04B 11/04; E04G 21/00

[52] U.S. Cl. ..... 52/714.13; 52/293.3; 52/295; 52/274; 52/745.1; 52/745.2

[58] Field of Search ..... 52/293.2, 293.3, 52/295, 274, 379, 742.14, 745.1, 745.2

[56] References Cited

U.S. PATENT DOCUMENTS

| | | | |
|---|---|---|---|
| 2,883,852 | 4/1959 | Midby | 52/274 X |
| 2,940,294 | 6/1960 | Carlson | 52/274 |
| 3,685,241 | 8/1972 | Cooper | 52/274 X |
| 4,219,978 | 9/1980 | Brown | 52/274 X |
| 4,290,246 | 9/1981 | Hilsey . | |

FOREIGN PATENT DOCUMENTS

| | | | |
|---|---|---|---|
| 5-163740 | 6/1993 | Japan | 52/293.3 |

*Primary Examiner*—Christopher Kent
*Assistant Examiner*—Brian E. Glessner
*Attorney, Agent, or Firm*—Tod R. Nissle, P.C.

[57] ABSTRACT

A method and apparatus simplify the construction of a concrete panel to include openings through which rebar and concrete slurry extend in order to anchor the panel in a trench at a construction site to form a wall. The method and apparatus of the invention also reduce the likelihood that the panel will settle and damage the panel.

2 Claims, 3 Drawing Sheets

FIG. 3
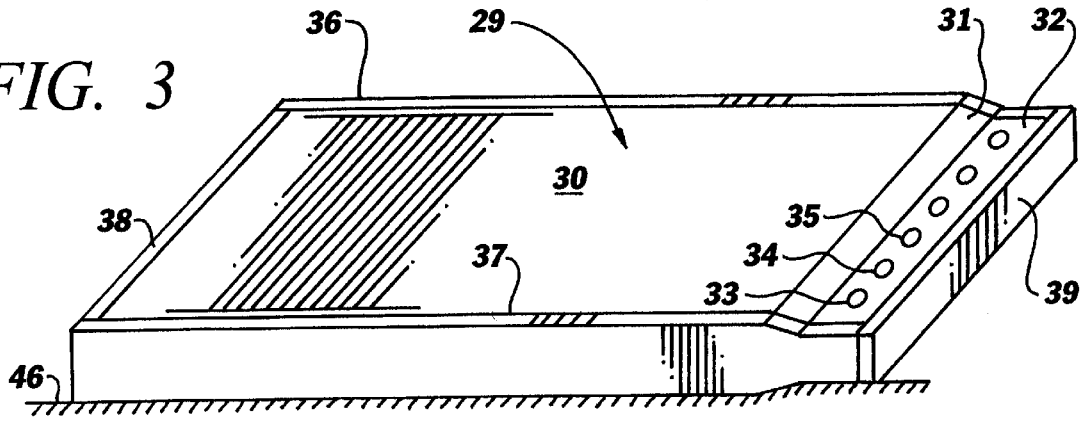
FIG. 4
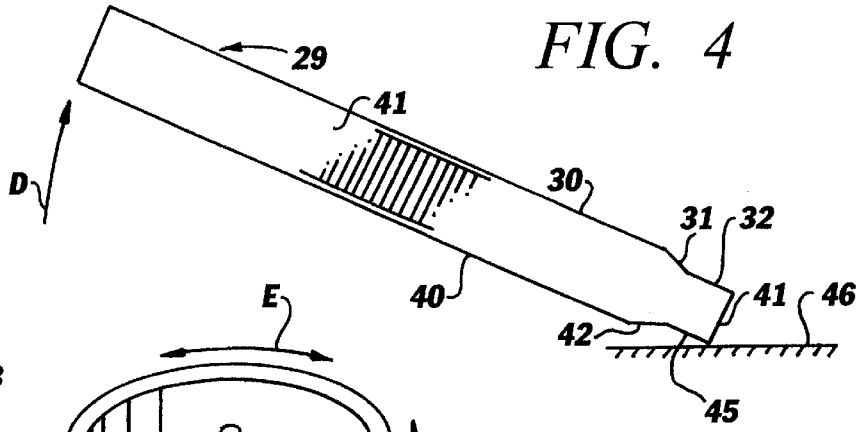
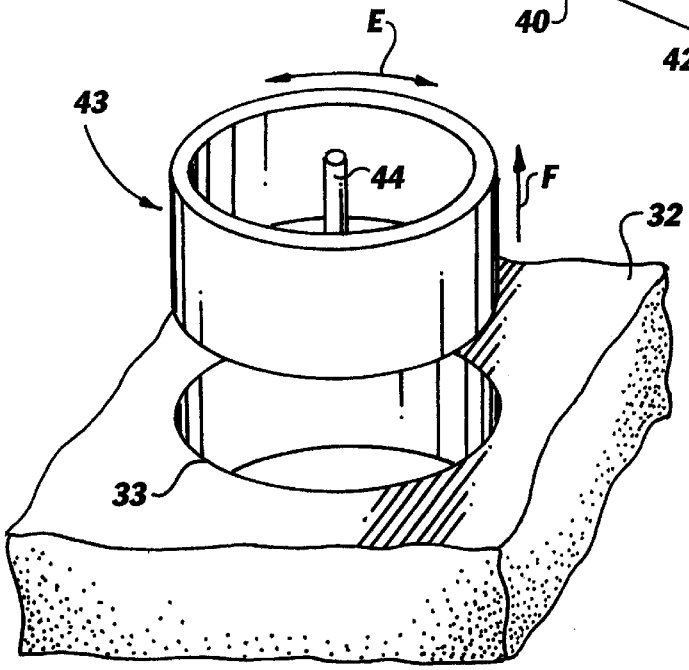
FIG. 5

METHOD AND APPARATUS FOR MANUFACTURING CONCRETE PANELS AND FOR CONSTRUCTING A WALL WITH THE PANELS

BACKGROUND OF THE INVENTION

This invention relates to a method and apparatus for constructing concrete panels and for utilizing the concrete panels is subsequent construction.

More particularly, the invention relates to a method and apparatus for simplifying the construction of concrete panels to include openings through which rebar and concrete slurry are extended in order to anchor the panel in a trench at a construction site to form a wall.

In a further respect, the invention relates to a method and apparatus for constructing a wall with a concrete panel in order to reduce the risk that the panel will, after the wall is constructed, settle and break.

U.S. Pat. No. 4,290,246 to Hilsey describes a concrete panel which includes a rectangular opening formed through the lower portion of the panel. The size of the rectangular opening is substantial and is preferably more than one-half of the width of the concrete panel. The Hilsey panel is installed at a construction site by setting the lower portion of the panel in a trench. Rebar is placed in and extends through the rectangular opening. The trench is filled with concrete slurry such that the slurry fills the rectangular opening and surrounds the rebar in the rectangular opening. While the concrete panel described in the Hilsey patent has been successfully utilized in constructing sound walls for freeways, the Hilsey panel has disadvantages. First, the large rectangular opening formed in the lower portion of the panel structurally weakens the panel, making it dangerous to attempt to raise the panel off the ground from a horizontal orientation by simply lifting the top of the panel and pivoting the panel about the lower edge of the panel contacting the ground. Instead, the panel is held at four points (two points on the upper portion of the panel and two points on the lower portion of the panel) and is tilted from a horizontal to a vertical orientation. Second, during manufacture of the panel, forming the rectangular opening requires additional forms which must be emplaced prior to pouring the concrete which produces the panel. Once concrete is poured and hardens, these additional forms must be "knocked out" prior to moving the panel. Third, when the panel is being anchored in a trench by pouring wet concrete through the rectangular opening, care must be taken to completely fill the rectangular opening with concrete to minimize structural weaknesses in the panel. Fourth, if the panel settles, breakage can occur along the upper edge of the rectangular openings, producing structural weaknesses which may form cracks in the panel.

OBJECTS OF THE PRESENT INVENTION

Accordingly, it would be highly desirable to provide an improved method and apparatus for producing and installing concrete panels.

Therefore, it is a principal object of the instant invention to provide an improved method and apparatus for producing and installing concrete panels.

Another object of the invention is to provide an improved method and apparatus for fabricating a concrete panel with openings which are utilized to receive rebar to anchor the panel.

A further object of the invention is to provide an improved method and apparatus for constructing a wall with a concrete panel such that the likelihood that the panel will settle and damage itself is minimized.

Yet another object of the invention is to provide an improved concrete panel which can be tipped on end without structurally damaging the panel.

These and other, further and more specific objects and advantages of the invention will be apparent to those skilled in the art from the following detailed description thereof, taken in conjunction with the drawings in which:

BRIEF DESCRIPTION OF THE DRAWINGS

FIG. 3 is a perspective view illustrating the fabrication of a concrete panel in accordance with the invention;

FIG. 4 is a side elevation view illustrating the righting of the concrete panel produced in accordance with FIG. 3; and, FIG. 5 is a perspective view illustrating the mode of operation of auxiliary molds utilized to form apertures in the lower portion of the concrete panel of FIG. 3.

SUMMARY OF THE INVENTION

Figure 1:
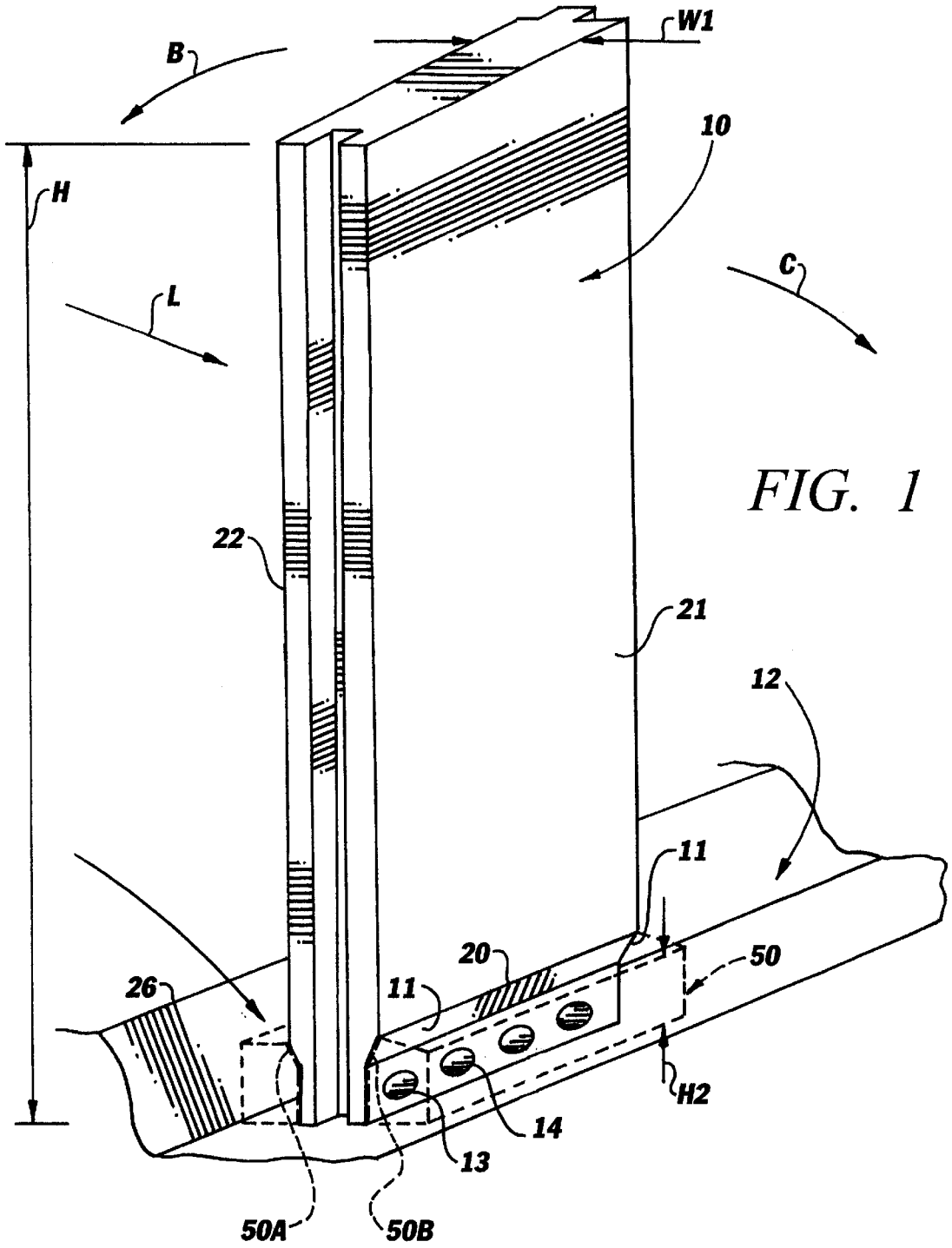
FIG. 1 is a perspective view illustrating a panel and wall constructed in accordance with the principles of the invention.

Briefly, in accordance with my invention, I provide, in combination with a trench formed in the ground at a building location, the improvements comprising construction apparatus for forming a wall in said trench. The construction apparatus includes at least one concrete panel. The concrete panel includes an upper portion having a first width and having a pair of outer spaced apart generally vertically oriented surfaces; a lower portion positioned in the trench and having a second width and having a pair of outer spaced apart generally vertically oriented surfaces; a tapered section interconnecting the upper and lower portions and including a first canted surface extending from one of the outer vertically oriented surfaces of the upper portion to one of the outer vertically oriented surfaces of the lower portion and including a second canted surface extending from the other of said vertically oriented surfaces of the upper portion to the other of the outer vertically oriented surfaces of the lower portion, the first and second canted surfaces being at an angle in the range of thirty degrees to sixty degrees with respect to the outer vertically oriented surfaces of the lower portion; a plurality of spaced apart apertures formed through the lower portion and generally normal to the outer vertically oriented surfaces of the lower portion, each of the apertures including a wall circumscribing and defining an opening extending through the lower portion; and, at least one rebar extending through and outwardly from each of the apertures and spaced apart from the wall of the aperture. The construction apparatus also includes a concrete footing positioned in the trench and contacting and extending over only the lower and intermediate portions of the panel. The footing includes canted surfaces which contact and oppose the canted surfaces of the intermediate portion and which function to prevent settling of the panel in the footing and to reduce the likelihood the sections of the panel adjacent and contacting the footing will crack and break off the panel. The footing also includes intercalating fingers each of which extends into and is interdigitized with a separate one of the openings intermediate the wall and the rebar in the opening to anchor the rebar in fixed position in the opening. The apertures in the panel are sized and spaced apart such that the panel can, without being broken, be moved from a horizontal to a vertical orientation by maintaining the lower portion in contact with a support surface and by lifting the upper portion to pivot the panel about the points at which the lower portion contacts the support surface.

In another embodiment of the invention, we provide a method of forming a wall. The method includes the step of preparing a horizontally oriented primary form. When the primary form is filled with concrete slurry which hardens in the form, the form produces a horizontally oriented concrete panel. The panel includes an upper portion having a first width and having a pair of outer spaced apart generally vertically oriented surfaces; a lower portion having a second width and having a pair of outer spaced apart generally vertically oriented surfaces; a tapered section interconnecting the upper and lower portions and including a first canted surface extending from one of the outer vertically oriented surfaces of the upper portion to one of the outer vertically oriented surfaces of the lower portion and including a second canted surface extending from the other of said vertically oriented surfaces of the upper portion to the other of the outer vertically oriented surfaces of the lower portion, the first and second canted surfaces being at an angle in the range of thirty degrees to sixty degrees with respect to the outer vertically oriented surfaces of the lower portion. The method also includes the steps of providing a plurality of cylindrical auxiliary forms; providing rotation means for turning the auxiliary forms; placing said cylindrical auxiliary forms in the primary form in spaced apart relationship such that when the primary form is filled with concrete slurry which hardens in the form to produce the panel, the panel includes a plurality of spaced apart apertures formed through the lower portion, each of the openings including a surface circumscribing and defining an opening extending through the lower portion, each of the apertures having a diameter of less than six inches; filling the primary form with concrete slurry; allowing said concrete slurry to harden; utilizing the rotation means to turn each of said auxiliary forms and extract the auxiliary form from the panel and from the associated aperture produced in the panel by the auxiliary form; removing the primary form from the panel; lifting the upper portion such that the lower portion rests on and maintains contact with a support surface and the panel pivots on the support surface to a vertical orientation, the apertures being sized and spaced apart such that the panel can, without breaking the panel, be moved from the horizontal to the vertical orientation by maintaining the lower portion in contact with the support surface and by lifting the upper portion to pivot the panel about the points at which the lower portion contacts the support surface; transporting the vertically oriented panel to a construction site; forming a trench in the ground at the construction site; positioning the panel such that the lower portion is in the trench; positioning rebar in each of the apertures such that the rebar is spaced apart from a surface circumscribing an opening associated with the aperture and extends outwardly from the opening and the lower portion; pouring in the trench a concrete slurry footing extending upwardly and covering only the lower and intermediate portions of the panel and including intercalating fingers each of which extends into and is interdigitized with a separate one of the openings intermediate the wall and the rebar in the opening to anchor the rebar in fixed position in the opening; and, permitting the footing to harden.

DETAILED DESCRIPTION OF THE INVENTION

Figure 2:
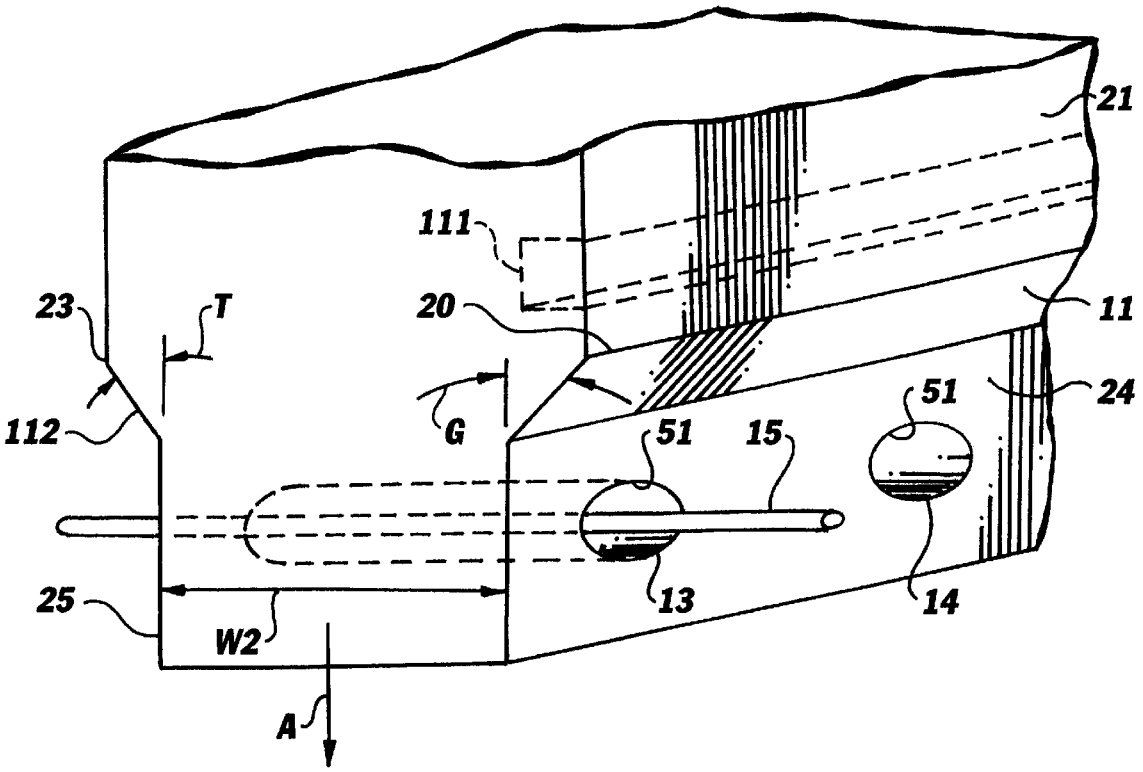
FIG. 2 is a perspective view of the lower portion of the panel of FIG. 1 illustrating the mode of operation thereof.

Turning now to the drawings which depict the presently preferred embodiments of the invention for the purpose of describing the operation thereof and not by way of limitation of the scope of the invention and in which like reference characters refer to corresponding elements throughout the several views, FIG. 1 illustrates a concrete panel 10 constructed in accordance with the invention and including an upper portion, intermediate portion, and lower portion. The upper portion has a flat planar front surface 21 and flat planar back surface 22. The width of the upper portion is indicated by arrows WI in FIG. 1. Rustications can, if desired, be formed in surfaces 21 and 22. Surfaces 21 and 22 (or surfaces 24 and 25) need not be parallel to one another, but can taper (converge or diverge toward or away from one another) or can take on any desired shape and dimension. The lower portion has a flat planar front surface 24 and a flat planar back surface 25. The width of the lower portion is indicated by arrows W2 in FIG. 2.

The intermediate portion interconnects the upper and lower portions of panel 10 and includes canted flat planar surfaces 11 and 112. Surface 11 interconnects parallel surfaces 24 and 21 and is at an angle G in the range of thirty to sixty, preferably forty-five, degrees with respect to planar surface 24. Surface 112 interconnects parallel surfaces 22 and 25 and is at an angle T (FIG. 2) of thirty to sixty, preferably forty-five, degrees with respect to planar surface 25. A plurality of spaced apart cylindrical apertures—including apertures 13, 14—extend completely through the lower portion of panel 10. Each aperture 13, 14 presently has a diameter in the range of about one inch to six inches, preferably about three inches, and includes a cylindrical inner wall which circumscribes and bounds a cylindrical opening extending through the lower portion of panel 10. Apertures 13, 14, etc. are each presently spaced apart on one foot centers, but the spacing between apertures 13, 14, etc. can vary as desired. Panel 10 includes only a single row of equally spaced apertures 13, 14, etc. If desired, two or more rows of apertures can be formed through the lower portion of panel 10; and, the spacing between and position of the apertures with respect to one another in the lower portion of panel 10 can vary as desired.

The height H of panel 10 can vary as desired, but presently is typically in the range of four feet to twenty feet. The width and other dimensions of panel 10 can also vary as desired.

When panel 10 is utilized to absorb sound, the width W1 of the upper portion of panel 10 presently typically increases from about five inches when the panel 10 is only four feet high to about twelve inches when panel 10 is twenty feet high. Rebar can be incorporated in panel 10 in conventional fashion to increase the strength of panel 10. The width W2 of the lower portion of panel 10 increases from about four inches when the panel is only four feet high to about nine inches when panel 10 is twenty feet high.

When panel 10 is utilized as a retaining wall, the width W1 of the upper portion of panel 10 presently is about ten inches regardless of the height of panel 10. The width W2 of the lower portion of panel 10 increases, however, from about ten inches when the panel 10 is only four feet high to about four feet when the panel 10 is thirty feet high. Further, when panel 10 is utilized as a retaining wall, earth is packed against surface 21, and, surface 21 (although still flat) is not parallel to vertical surface 22 but instead slopes away from surface 22 at about one-eighth of an inch per vertical foot so that the distance between surfaces 21 and 22 increases while traveling from the top of wall 10 downwardly toward the intermediate and lower portions of wall 10.

During installation of panel 10, panel 10 is vertically oriented and positioned in a trench 26 in the manner illustrated in FIG. 1, and is temporarily braced to maintain panel 10 in a vertical orientation. Rebar 15 is positioned in each aperture 13, 14 such that the rebar 15 is spaced away from the inner cylindrical wall 51 of aperture 13, 14 and is centered in the opening circumscribed by the inner cylindrical wall 51. The ends of rebar 15 extends outwardly away from surfaces 24 and 25 in the manner shown in FIG. 2. Wire or other means can be utilized to maintain rebar 15 in a centered position in each aperture 13, 14, etc. Concrete slurry is poured in trench 26 to contact and to cover substantially completely the lower and intermediate portions of panel 10 and to flow into apertures 13, 14, etc. and intermediate and in contact with both the rebar and the inner cylindrical surface 51 of each aperture 13, 14. When the concrete slurry hardens it forms a footing which includes intercalating concrete fmgers which are interdigitized with (i.e., which extend into) the apertures 13, 14 in the lower portion of panel 10. The intercalating concrete fingers contact both the rebar 15 and at least a portion of the inner cylindrical surface 51 of each aperture 13, 14 and function to maintain rebar 15 in fixed position in each aperture 13, 14 and to anchor panel 10 in the hardened concrete footing 50. Once footing 50 hardens, the temporary bracing used to hold panel 10 is removed. In addition, after footing hardens, trench 26 can, if desired, be completely filled in with earth or other fill material.

Footing 50 can be formed by pouring concrete directly into and at least partially filling trench 26, or, a footing form can be constructed in trench 26 so that when concrete is poured into trench 26 it is poured into the footing form and the footing formed is like the footing indicated by dashed lines 50 in FIG. 1 and is smaller than trench 26.

Canted surfaces 11 and 112 on the intermediate portion of panel 10 are important in the practice of the invention because they interact with opposing canted surfaces 50A, 50B on footing 50. The opposing surfaces 50A, 50B conform to and contact surfaces 112 and 11, respectively. The opposing canted surfaces 50A, 50B contact and cooperate with surfaces 112 and 11 to prevent movement or tilting of panel 10 in the directions indicated by arrows B and C and to prevent settling of panel 10 in the direction of arrow A in FIG. 2. If panel 10 begins to settle in the direction of arrow A, canted surfaces 112 and 11 bear against the opposing canted surfaces 50A and 50B, respectively, on footing 50 and reduce the risk that edges 20 and 23 of panel 10 will break and impair the structural integrity of panel 10. A U-shaped groove 111 can be formed in panel 10.

The fabrication of a concrete panel 29 in accordance with the invention is illustrated in FIGS. 3 to 5. It is understood that panel 10 depicted in FIGS. 1 and 2 can also be fabricated in the manner described below with respect to FIGS. 3 to 5.

A primary form including members 36 to 39 is constructed in the manner illustrated in FIG. 3. The ground 46 beneath the form conforms to the shape defined by the lower edges of members 36 to 39 so that a panel 29 with the side profile illustrated in FIG. 4 is ultimately produced. After the primary form is constructed, a plurality of cylindrical auxiliary forms 43 are positioned in spaced apart positions in the primary form such that a plurality of apertures including apertures 33 to 35 are formed when concrete slurry is poured in the primary form and hardens. Rebar, wire, or other means is utilized to maintain forms 43 in position in the primary form. Rebar, wire, or other structural components can also, if desired, be positioned in the primary form in conventional fashion to strengthen the wall panel subsequently produced by pouring concrete in the primary form.

Wet concrete slurry is poured into the primary form and is tamped, vibrated, and/or smoothed as desired to conform the concrete to the primary form in the manner illustrated in FIG. 3. As used herein, a concrete slurry is any cementitious slurry that hardens to form a substantially rigid, hard panel 10 or 29. The concrete slurry begins to harden about two or three hours after the slurry is poured into the primary form. Once the slurry begins to harden, the handle 44 of each auxiliary form 43 is manually grasped and turned in the direction of arrow E to break the form 43 free from the adjacent concrete. Handle 44 is also grasped to manually lift each form 43 in the direction of arrow F to remove the form 43 from the aperture 33, 34, or 35 or other aperture produced by form 43 in and extending completely through the lower portion of panel 29. Any mechanical means or other means can be used to rotate form 43 and remove it from panel 29 when the concrete comprising panel 29 begins to set up. In FIG. 3, forms 43 have been removed from each aperture 33, 34, 35, etc. formed in the lower portion of panel 29.

Once the concrete comprising panel 29 has hardened sufficiently—usually after about twenty-four hours—the primary form members 36 to 39 are removed from around panel 29. Panel 29 includes an upper portion having front 30 and back 40 parallel flat planar surfaces. The lower portion of panel 29 includes parallel front 32 and back 45 planar parallel surfaces and includes a plurality of cylindrical apertures including cylindrical apertures 33 to 35 extending from the front 32 planar surface to the back 45 planar surface. The intermediate portion of panel 39 includes canted surface 31 interconnecting parallel surfaces 30 and 32 and includes canted surface 42 interconnecting parallel planar surfaces 40 and 45. Surfaces 31 and 42 are, in a manner similar to that of surfaces 11 and 112 with respect to surfaces 24 and 25 in FIG. 1, canted at an angle in the range of thirty to sixty degrees with respect to surfaces 32 and 45, respectively.

The number of, size of, shape of, and spacing between each adjacent pair of apertures 33, 34, 35, etc. formed in the lower portion of panel 29 affects the structural integrity of said lower portion. The number of, size of, shape of, and spacing between the apertures in the lower portion of panel 29 is controlled so that the upper portion of panel 29 can safely and without breakage be lifted upwardly in the direction of arrow D in FIG. 4 from a horizontal to a vertical orientation while the lower portion of panel 29 maintains contact with and pivot on the ground 46 or other support surface. Being able to tilt panel 29 on the ground in the manner illustrated in FIG. 4 simplifies the transport and installation of panel 29.

Panels 10, 29 constructed in accordance with the invention can be used in retaining walls, load bearing walls, building foundations, exterior and interior walls in various military and commercial buildings, fences, and any other structures utilizing concrete panels.

Having described my invention in such terms as to enable those skilled in the art to make and practice the invention, I claim:

1. In combination with a trench formed in the ground at a building location, the improvements comprising construction means for forming a wall in said trench, said construction means including (a) at least one concrete panel including (i) an upper portion having a first width, and a pair of outer spaced apart generally vertically oriented surfaces, (ii) a lower portion positioned in said trench and having a second width, and a pair of outer spaced apart generally vertically oriented surfaces, (iii) an intermediate interconnecting said upper and lower portions and including a first canted surface extending from one of said outer vertically oriented surfaces of said upper portion to one of said outer vertically oriented surfaces of said lower portion, and a second canted surface extending from the other of said outer vertically oriented surfaces of said upper portion to the other of said outer vertically oriented surfaces of said lower portion, said first and second canted surfaces being at an angle in the range of thirty degrees to sixty degrees with respect to said outer vertically oriented surfaces of said lower portion, (iv) a plurality of spaced apart apertures formed through said lower portion and generally normal to said outer vertically oriented surfaces of said lower portion, each of said apertures including a wall circumscribing and defining an opening extending through said lower portion, and (v) at least one rebar extending through and outwardly from each of said apertures and spaced apart from said wall of said apertures; and, (b) a concrete footing positioned in said trench and contacting and extending over only said lower and intermediate portions of said panel, said footing including (i) canted surfaces which contact and oppose said canted surfaces of said intermediate portion and which function to prevent settling of said panel in said footing and to reduce the likelihood the sections of said panel adjacent and contacting said footing will crack and break off said panel; and, (ii) intercalating fingers each of which extends into and is interdigitized with a separate one of said openings intermediate said wall and said rebar in said opening to anchor said rebar in a fixed position in said opening;

said apertures being sized and spaced apart such that said panel can, without breaking said panel, be moved from a horizontal to a vertical orientation by maintaining said lower portion in contact with a support surface and by lifting said upper portion to pivot said panel about the points at which said lower portion contacts said support surface.

2. A method of forming a wall, said method including the steps of (a) preparing a horizontally oriented primary form, said form, when filled with a concrete slurry which hardens in the form, producing a horizontally oriented concrete panel including (i) an upper portion having a first width, and a pair of outer spaced apart generally vertically oriented surfaces, (ii) a lower portion positioned in said trench and having a second width, and a pair of outer spaced apart generally vertically oriented surfaces, (iii) an intermediate section interconnecting said upper and lower portions and including a first canted surface extending from one of said outer vertically oriented surfaces of said upper portion to one of said outer vertically oriented surfaces of said lower portion, and a second canted surface extending from the other of said outer vertically oriented surfaces of said upper portion to the other of said outer vertically oriented surfaces of said lower portion, said first and second canted surfaces being at an angle in the range of thirty degrees to sixty degrees with respect to said outer vertically oriented surfaces of said lower portion;

(b) providing a plurality of cylindrical auxiliary forms;

(c) providing rotation means for turning said auxiliary forms;

(d) placing said cylindrical auxiliary forms in said primary form in spaced apart relationship such that when said primary form is filled with concrete slurry which hardens in said form to produce a panel, said panel includes a plurality of spaced apart apertures formed through said lower portion, each of said apertures including a surface circumscribing and defining an opening extending through said lower portion;

(e) filling said primary form with concrete slurry;

(f) allowing said concrete slurry to harden;

(g) utilizing said rotation means to turn each of said auxiliary forms and extract said auxiliary forms from said panel and from said apertures produced in said panel by each of said auxiliary forms;

(h) removing said primary form from said panel;

(i) lifting said upper portion such that said lower portion rests on and maintains contact with a support surface and said panel pivots on said support surface to a vertical orientation, said apertures being sized and spaced apart such that said panel can, without breaking said panel, be moved from the horizontal to the vertical orientation by maintaining said lower portion in contact with said support surface and by lifting said upper portion to pivot said panel about the points at which said lower portion contacts said support surface;

(j) transporting said panel to a construction site;

(k) forming a trench in the ground at the construction site;

(l) positioning said panel such that said lower portion is in said trench;

(m) positioning rebar in each of said apertures such that said rebar is spaced apart from said surface circumscribing said opening associated with each of said apertures and extends outwardly from said opening and said lower portion;

(n) pouring in said trench a concrete slurry footing extending upwardly and covering only said lower and intermediate portions of said panel and including intercalating fmgers each of which extends into and is interdigitized with a separate one of said openings intermediate said wall and said rebar in said opening to anchor said rebar in fixed position in said opening; and, (o) permitting said footing to harden.

* * * * *